United States Patent [19]

Bevans

[11] Patent Number: 4,488,497

[45] Date of Patent: Dec. 18, 1984

[54] ADJUSTABLE TOOL TRAY

[76] Inventor: William J. Bevans, 9129 Summer Park Dr., Baltimore, Md. 21234

[21] Appl. No.: 375,087

[22] Filed: May 5, 1982

[51] Int. Cl.[3] ..... A47B 9/00

[52] U.S. Cl. ..... 108/144; 108/23; 108/134

[58] Field of Search ..... 108/141, 144, 134, 147, 108/124, 115, 23; 248/240.4, 293, 125; 16/297

[56] References Cited

U.S. PATENT DOCUMENTS

| | | | |
|---|---|---|---|
| 1,220,758 | 3/1917 | Lamphiear | 248/293 X |
| 1,394,526 | 10/1921 | Amsden | 108/141 X |
| 1,725,329 | 8/1929 | Blandford | 108/147 X |
| 2,585,111 | 2/1952 | Grauer | 108/144 X |
| 2,677,518 | 5/1954 | Happy et al. | 248/125 |
| 2,692,175 | 10/1954 | Jacques | 108/124 |
| 2,854,148 | 9/1958 | Mattos et al. | 248/293 X |
| 3,123,935 | 3/1964 | Williams | 108/25 X |
| 3,494,306 | 2/1970 | Aguilar | 108/6 |
| 4,401,036 | 8/1983 | Russo et al. | 108/144 |

FOREIGN PATENT DOCUMENTS

| | | | |
|---|---|---|---|
| 405174 | 4/1967 | Australia | 108/6 |

*Primary Examiner*—William E. Lyddane
*Assistant Examiner*—Peter A. Aschenbrenner
*Attorney, Agent, or Firm*—Sherman Levy

[57] ABSTRACT

Adjustable tool tray assembly having a vertical upstanding support member with a series of spaced diametrical holes passing through the support member parallel to each other, a "U" shaped bracket forming a base and supporting the vertical support member at its lower end about a mid-point of a central section of a "U" shaped bracket angulated members for bracing respective corners of the "U" shaped bracket with respect to the vertical support member, a pair of sleeve members disposed in telescopic and sliding relation with the vertical support member and having diametrical holes passing therethrough, a generally "U" shaped rigid frame having a mid-point of its central section thereof supporting an intermediate portion of one of the pair of sleeve members, and a generally rectangularly configured tray means supported from the "U" shaped rigid frame. Casters are provided for supporting the base for rolling, and an electrical socket can be located on a side or back wall of the tray means, and utility extension arms can be provided on the other sleeve member. A securing means can be provided for engaging the sleeve with a vertical support member and the securing means thereof can be placed in any of the desired diametrical holes. A handle can be provided on one of the sleeve members, and the table may be provided with a magnetic plate structure embedded in or disposed on the surface of the tray means. The tool tray assembly is pivoted or hinged and with a lock or support pin, the tray can be raised and locked in place for use, and when service thereof is completed, the support pin is removed so the tray assembly is lowered to a down-position for storing.

10 Claims, 7 Drawing Figures

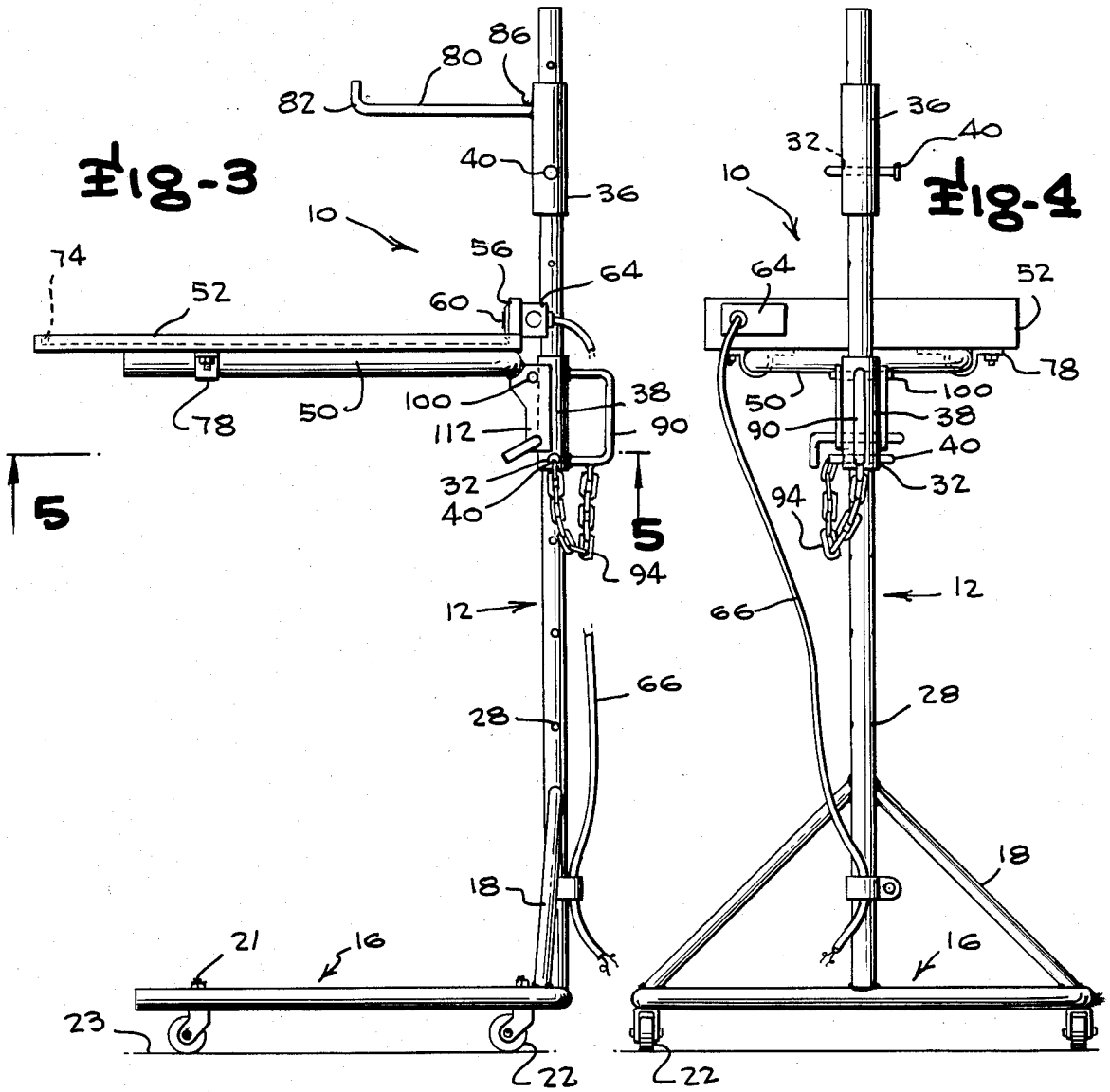
Fig-3
Fig-4
10
12
16
18
21
22
23
28
32
36
38
40
50
52
56
60
64
66
74
78
80
82
86
90
94
100
112
5
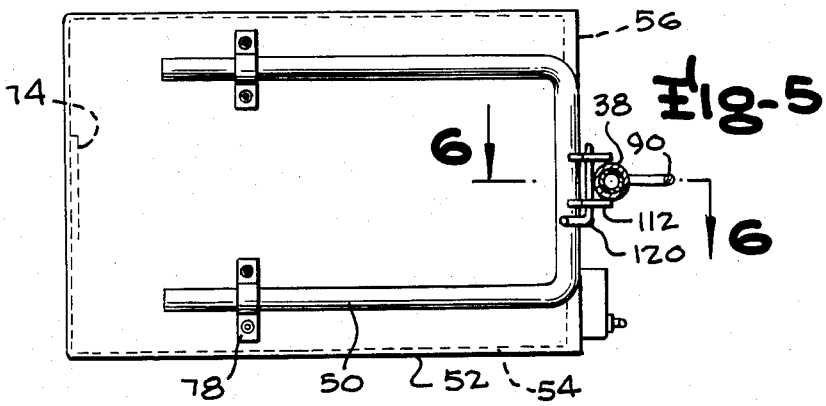
Fig-5
6
38
50
52
54
56
74
78
90
112
120

ADJUSTABLE TOOL TRAY

BACKGROUND OF THE INVENTION

1. Field of the Invention

The present invention relates to a new and improved adjustable tool tray for mechanics, repairmen, or handy persons needing to be provided with shelf or table space during the course of performing a mechanical operation or repair and maintenence services. More particularly, the invention relates to a mechanic's adjustable tool tray having simple construction, formed of heavy-duty tubing or mechanical elements, and for providing support of a thick, heavy-duty plastic table surface with a magnetic member embedded therein and an electric double plug outlet located on a wall of the tray at the other end of which may be connected an extension cord for use and hook up with power tools, drop lights, radio receivers and the like. Also, within the purview of the present invention, the heavy-duty plastic tray with table surface may be dismantled from the adjustable tool tray assembly and may be used separately as a work surface positioned beneath an automobile or other vehicular structure that is inaccessable for use with the entire adjustable tool tray assembly, but in which it is desired to provide work space and securing surfaces for parts of equipment being dismantled, maintained or repaired accordingly.

2. Disclosure of Prior Art

Various forms of tool table constructions, equipment holder apparatus having table work surfaces, and the like, are known in the prior art and exemplary of the U.S. prior patent art are the following:

U.S. Pat. No. 4,119,044 R. E. Hines

U.S. Pat. No. 4,122,956 M. G. Hargrove

U.S. Pat. No. 4,186,784 J. T. Stone.

The reference to Stone discloses a tool table construction for mounting saws and routers and does not show any arrangement for providing adjustability in the height of the table.

The patent to Hargrove is a tool holder apparatus for repair of internal combustion engine components and provides a shelf for nuts, bolts, and tool parts where the work stand is constructed of heavy-duty steel and is adapted for use in and about gas stations, auto dealers and the like.

The patent to Hines discloses a tool caddy in the form of a wheeled carrier of tools that is provided with a readily removable tool-carrying tray.

None of these patents have disclosures that bear upon any claim of the present invention.

SUMMARY OF THE INVENTION

An object and advantage of the present invention is to provide a new and improved adjustable tool tray assembly that affords greater flexibility and manner of usage while yet being capable of being manufactured in a simple and most direct manner.

Another object and advantage of the present invention is to provide an adjustable tool tray assembly that is useful in assisting mechanics, maintenence personnel and repair people with a table surface or work space that is strong and yet easily removable from place to place about the work area and yet provides verticle mobility as the table of the tool tray is adjusted upwardly or downwardly for accomodating to the work area about the vehicle being repaired or maintained. The adjustable tool tray of the apparatus of the present invention may be placed close to the engine or other area of the automotive vehicle and yet eliminates unnecessary movement of having to leave the work position in search of tools, parts, electrical connections and the like.

The table surface of the present invention is provided with an electrical outlet and has its cord clamped to a base portion of the adjustable tool tray assembly so that the assembly is not easily turned or pulled over about its base.

Another object and advantage of the present invention is to provide a tray surface structure made of heavy-duty plastic material that does not need painting or surface care and yet has the advantage that electrical shock is prevented due to the insulation characteristics of plastic surface of the tray, and yet it can serve as a utility arm and retain parts thereof and can be supported within the edge or lip of the tray surface.

Also a magnetic plate can be secured on or embedded in the plastic material of the tray.

An adjustable utility arm or arms is positioned on top of the tray and on top of the vertical support member from which there is provided space to hang a drop line, gaskets, other items and the like that will not be lost or damaged.

The tray surface of the adjustable tool tray assembly has a double electrical outlet or female plug for use or connection to power tools, drop light, radio, or for general utility and is connected to an extension cord snapped to the bottom of the stand for its ease in connection to a wall outlet.

A further and additional object of the present invention is to provide an adjustable tool tray assembly in which the tool tray is provided with a magnet located about front or top surface of the tray for keeping nuts, bolts and screws from being lost from the immediate location of the tray and for otherwise ease of retreival.

The tray member of the assembly is retained by a gear shaped member secured to a slidable sleeve extending from a vertical support, and the tray is secured to the "U" shaped bracket by straps that provide for ease in removal. The sleeve is telescopically engaged with the vertical support and each has diametrical holes therethrough for receiving a lock rod that is removed for raising or lowering the tray and for securing it in place by reinsertion of the rod into the sleeve and vertical support member.

The base is also constructed in the form of a symmetrically and slightly larger "U" shaped base so that the vertical support member is welded and extends upwardly from a mid-portion of the center of the "U" shaped structure.

The sleeve supporting the tray is provided with a handle that provides an ease of raising or lowering the tray during adjustment.

The aluminum rod is inserted into the diametrical hole for stablizing the tray onto the vertical support when the proper height is determined and yet provides the advantage of access both to the tray when it is in a lower position for a low work job, or in a higher work area when the job is at a higher level.

Also, the work tray can be removed from the work stand and used as a separate component underneath a vehicle where the stand is otherwise not capable of being used.

A particular advantage of the tray is that it is of non-conductible material, and does not provide an electrical hazard to the user during maintenence or repair of vehicles, or the like.

These, together with other objects and advantages which will become subsequently apparant, reside in the details of construction and operation that are more fully here and after ward described and claimed, reference being had to the accompanying drawings forming a part hereof, wherein like numerals refer to like parts throughout.

BRIEF DESCRIPTION OF THE SEVERAL VIEWS OF THE DRAWINGS

FIG. 3 is a right side elevational view of the assembly showing details of the pivot or hinge arrangement.

FIG. 4 is a rear elevational view of the assembly.

FIG. 5 is a sectional view taken along lines 5—5 of FIG. 3.

DESCRIPTION OF A PREFERRED EMBODIMENT

Figure 1:
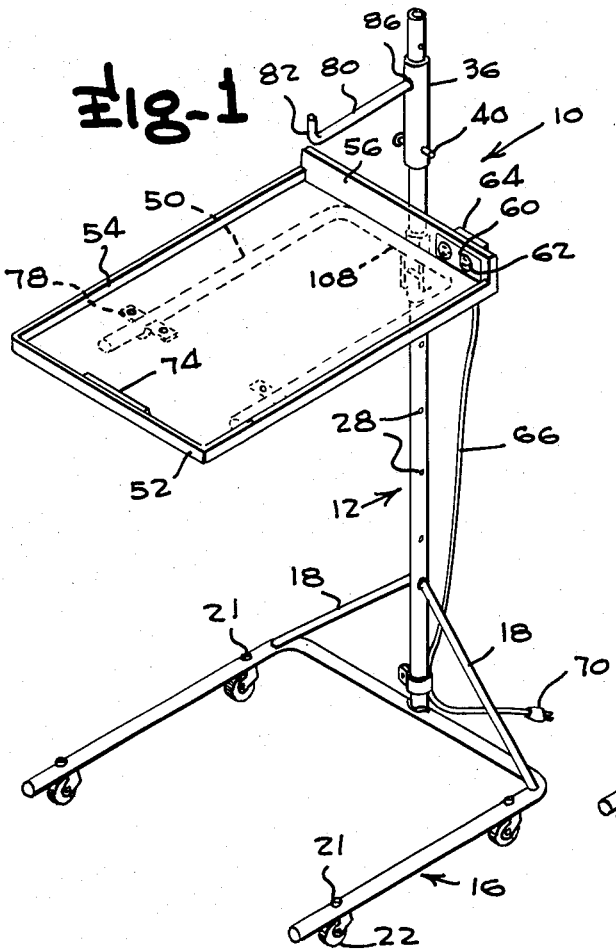
FIG. 1 is a front perspective view of the adjustable tool tray assembly showing the tray in up-position according to a preferred exbodiment of the invention.

Referring now to the drawings there is shown an adjustable tool tray assembly 10 having a vertical upstanding rigid support member 12 of aluminum tubing or other metal or of a strong plastic material and which is preferrably hollow, or may be solid and having its lower terminal end 14 engaging and securely affixed to a mid-portion of a central member of a "U" shaped rigid support bracket or base 16. The base 16 is provided with angulated support rods 18 disposed between corners of the "U" shaped base 16 and adjacent to intermediate portion of the support member 12 so that there is, by construction of the support rods 18 in a general triangular configuration, a degree of rigidity and support available to the vertical member 12 provided by the base 16. The ends of the rods 18 are welded to or similarly secured onto the adjacent members 12 and base 16.

The corners of the "U" shaped base 16 form a 90° turn with components of the base 16 and a generally 30°-60° angle with the support rods 18. Holes or caster receiving apertures 21 may be disposed within the base 16 at spaced locations, generally approximate the ends or sides of the "U" shaped base 16, from which there are mounted rollers or swivel casters 22. These casters may be removed where it is desired that the adjustable tool tray assembly is not to be moved about on its supporting surface 23, but casters 22 provide ease in moving about when the work area is to be moved about from one vehicle or job location to another accordingly.

From the weldment intersections of the support rods 18 with the vertical member 12 and vertically upwardly therefrom, there are a plurality of transverse or diametrical holes 28 which are through drilled at generally equal distances and on a common side throughout the vertical support member 12 and are adapted to be aligned with similar diametrical holes 32 either of a pair of telescopic sleeve members 36, 38 disposed in telescopic relation with the vertical support member 12 as shown.

Passing through the aligned openings or holes 28, 32 is a support rod 40 for mating with a hole and securing the sleeve members into fixed relation with the support member 12. Adjustments or relocation of the telescopic sleeve members 36,38 is possible by withdrawing the rod 40 for the aligned holes 32 and then allowing the sleeve 36, 38 to be relocated to a desired location where another set of holes 32 are aligned and then the rod 40 is reinserted to stably locate the sleeves 36, 38.

Figure 2:
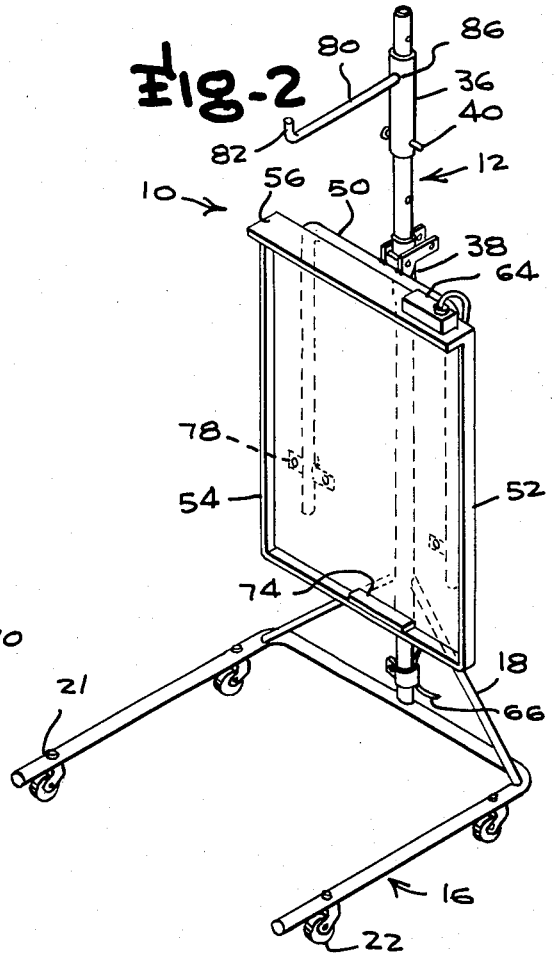
FIG. 2 is a perspective view of the adjustable tool tray in down-position.

On the sleeve 38 as shown in FIGS. 1 and 2 there is welded or otherwise securely affixed a mid-portion of the central member of a "U" shaped frame 50 shown in phantom in FIG. 1 and extending horizontally from the vertical support mexber 12 but in a generally symmetrical relation with the "U" shaped support base 16 as shown in FIG. 1. Upon the "U" shaped frame 50 there is stably supported and securely affixed thereto upon the upper surface thereof a thick, heavy-duty plastic tray 52 having upwardly extending lips or edges 54 extending around substantially the entire periphery of the tray 52. The tray 52 may be provided with a work wall or flange 56 upon which identifying indicia may be provided, decals may be fixed, and in which a double female plug or outlet 60 is located and secured in place with screws 62 engaging an electrical outlet box 64 for ease of removal, repair or maintenence, and there is attached to a rear side of the box 64 a 55 to 60 inch extension cord 66 having its free end terminating in a three-prong electrical plug 70 for ease in hookup with a further extension cord (not shown) so that power is available from the adjustable tool tray assembly 10 by coupling and ease of hook-up to power tools, drop lights, radios and the like. The back of the outlet 60 has the cover box 64 that protects access to the several outlets 60.

Within a locale, preferably along an edge surface distal from flange 56 there is a magnetic plate 74 bonded onto or within the plastic material forming the tray 52, but near enough the surface of the tray 52 for providing security to loose nuts, bolts, and screws which are thereby retained in one place due to the magnetic effect of the magnetic plate 74. The magnetic plate in an alternative arrangement may be glued or otherwise secured onto the tray 52.

It should be mentioned that the "U" shaped frame 50 is secured to an underside of the tray 52 by means of tray connection strap 78 which may be made of aluminum or other similar materials located under the tray to secure the tray into position and for ease of removal, repair and the like. Also, when the tray 52 is dismantled by removal of the telescopic sleeve 38 from the support 12, the "U" shaped frame 50 and tray 52 used as a single element component of the entire kit or assembly 10 provides for utilization of the frame 50 as a base to support the tray 52 when used in a work place such as under the automotive vehicle or the like.

The other sleeve 36, being similarly supported from the vertical support member 12 by a rod 40 is provided with one or more utility arms 80 from which use is available for hinging drop lights, circular objects such as gaskets and the like, and may be of sufficient length such as 8-12 inches, preferably 10 inches, and are turned up at approximately a 90° angle at the distal or free end 82 of the utility arm 80, while the other end 84 is welded, spot-welded or the like directly onto the sleeve 36 by weldment 86.

FIGS. 3-7 show the sleeve 38 provided with an adjustment or holding handle 90 which is a generally "C"

or "D" shaped structure having each end spot-welded to the sleeve 38 by weldments 92 to provide grasping means for adjusting of the tray 52 upwardly, downwardly, or the like. Each of the sleeves 36,38 is provided with rods 40 to lock and support the sleeve in stable condition, and within the scope of the preferred embodiment a small link chain 94 is spot-welded at one end to the sleeves 36, 38 and has its other end attached similarly to an end of the rod 40 so that the other end of the rod is available for insertion into aligned holes 32 and can be inserted therein along any intermediate portion of the support member 12. When the aluminum rod 40 is inserted into the aligned holes 32, the tray 52 in the case of sleeve 38 is held and stabilized at a desired height and the sleeve 36 is held at its desired height so that a utility arm is available for hinging a drop cord, support gaskets or the like. It is within the purview of the present invention that the utility arm 80 can be mounted beneath the tray 52, providing added versitility as desired, but then another arrangement of use of the adjustable tool tray assembly 10 of the invention it is preferred that the utility arm 80 be mounted and provided for use above the tray 52.

The component parts of the adjustable tool tray assembly 10 can be made of iron, aluminum, steel members or pipes, whether hollow or solid, however, it is understood that the tray 52 is of a strong and rigidly constructed thick, heavy-duty plastic material. The several members are formed in a unitary structure by spot-welding or other method of metal treatment that rigidly secures the metal parts together in the manner taught within the purview of the present invention.

Figure 6:
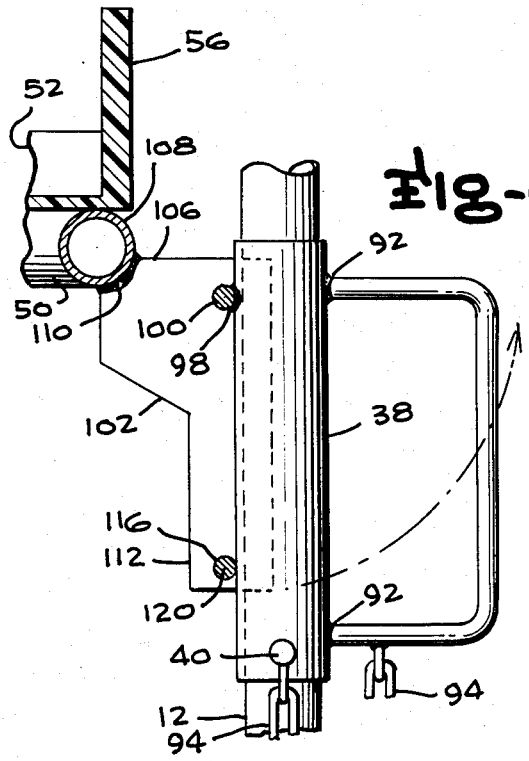
FIG. 6 is a fragmented and enlarged sectional view taken along lines 6—6 of FIG. 5.
Figure 7:
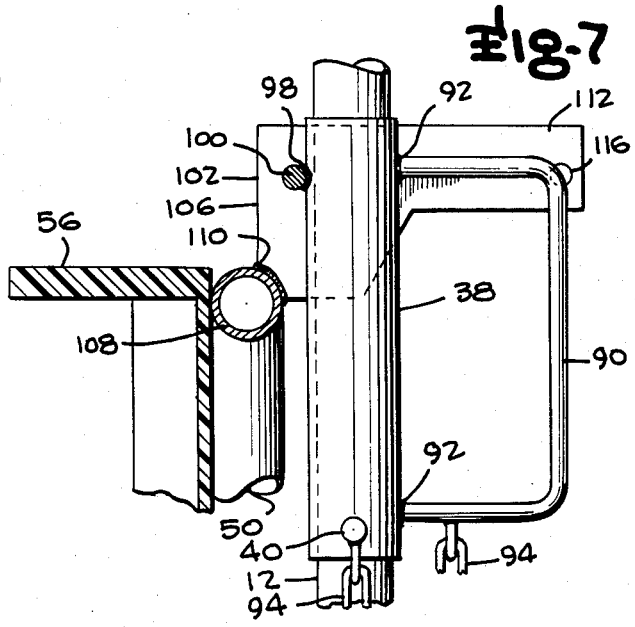
FIG. 7 is a fragmented and enlarged sectional view similar to that of FIG. 6 and showing the tray assembly in the down position.

FIGS. 5–7 illustrate a preferred manner of adjustment and pivoting the table or tray 52 from horizontal to a vertical position for storage and with the rod 40 removed. The sleeve 38 supports by weldment 98 a stably support pin 100 welded to the sleeve 38 and supported from ends of the pin 100 in pivotal or hinge relation are a pair of generally "pistol shaped" brace plates 102 and on each side of the sleeve 38 "handle end" 106 of the plates 102 is welded to the central portion 108 of "U" shaped frame 50 by weldment 110 and the other end 112 of the plates 102 contains an aperture 116 for receiving a stable support rod 120. The weldments 98, 110 provide for stably securing the plates 102 in a parallel relation throughout, and the pin 100 maintains the plates on the pin by reason of the strong weldments 110 spacing the plates in relation to the portion 108.

FIG. 7 shows the tray 52 in its contemplated down position and for storage of the assembly 10 as not in use. FIGS. 5 and 6 illustrate completion of having raised the tray 52 by grasping a distal edge of the tray 52 and by raising or pivoting the tray around the hinge pin 100, the end 112 and its aperture 116 rotate about the pin 100 (clockwise in FIG. 7) to the view shown in FIG. 6, and as the apertures 116 pass the sleeve 38 and become in alignment-free relation to each other, the rod 120 is then inserted through the apertures 116 and the mid-portion of the pin 120, shown in FIG. 5 to be an angle rod, and the tray 52 is stably supported in its upright position.

The foregoing is considered as illustrative only of the principles of the invention. Further, numerous modifications and changes will readily occur to those skilled in the art and it is not desired to limit the invention to the exact construction and operation shown and described and accordingly, all simple modifcations and equivalents may be resorted to falling within the scope of the present invention.

What is claimed and desired to be secured by Letters Patent is:

1. In an adjustable tool tray assembly for use in the automotive field, a vertical upstanding rigid support member having an upper end and a lower end with a series of spaced apart diametrical holes passing through the support member and each being generally parallel to the others; a "U" shaped rigid support bracket disposed horizontally relative to said support member at its lower end and connected to the vertical support member about a mid-point of a central section of the "U" shaped bracket; angulated rod members for bracing respective corners of the "U" shaped bracket with an intermediate portion of the vertical support member and forming a triangular support structure thereby; a pair of vertically adjustable sleeve members disposed in telescopic and sliding relation with respect to the vertical support member, each sleeve member having at least one diametrical hole passing therethrough, securing elements selectively extending through certain holes in the sleeve members and vertical support member for maintaining and retaining the sleeve members in their adjusted positions on the vertical support member; a generally "U" shaped rigid frame having a midpoint of its central section thereof supported from and operatively connected to an intermediate portion of one of the pair of sleeve members; a generally rectangularly configured tray means supportably mounted from the "U" shaped rigid frame, and a power outlet located on the back of the tray means.

2. The invention of claim 1 wherein each of the sleeve members has means associated therewith for stably securing the sleeve members in a given position including means for interposing a rod means through aligned holes of the respective sleeve members and the vertical support member.

3. The invention of claim 2 wherein the securing means includes a chain piece spot-welded to at least one of the sleeve members at one end and to the rod means at the other thereof.

4. The invention according to claim 1 wherein the elements are constructed of metal such as aluminum tubing or the like, and the tray means is constructed of thick, heavy-duty plastic material.

5. The invention according to claim 1 wherein the various members except the tray means are constructed of hollow one-piece elements spot-welded together, and a pair of brace plates welded to the central section of the "U" shaped frame, the brace plates being pivotally supported from a support pin and means being provided in the brace plates to selectively secure the plates to support the tray horizontally.

6. The invention according to claim 1 wherein a set of spaced swivel wheels are supportedly affixed to be operably mounted beneath the "U" shaped rigid support brackets and being disposed at the lower end of vertical support member.

7. The invention according to claim 1 wherein another sleeve member has rod means secured to the sleeve by means of a connected flexible chain means.

8. The invention according to claim 1 wherein at least one of the sleeves is provided with a metal handle spot-welded to the sleeve for providing adjustment in displacing tray means upwardly or downwardly during adjustment when the rod thereof is removed and for replacement of the rod when the holes are in proper aligned position.

9. The invention according to claim 1 wherein the tray means is a heavy-duty, generally rectangular plastic structure and having an upstanding edge extending around its entire periphery thereof.

10. The invention according to claim 1 wherein a tray means is provided with a magnetic plate structure embedded and securely affixed to the tray means distal from the support member and adapted for keeping the loose nuts, bolts, and screws in one place on the top surface of the tray, the magnetic plate being bonded to said tray by glue means.

* * * * *